US006390840B1

(12) United States Patent
Wang

(10) Patent No.: US 6,390,840 B1
(45) Date of Patent: May 21, 2002

(54) AUTO TERMINATION PCB MOUNT CONNECTOR

(75) Inventor: Tsan-Chi Wang, Hsin-Tien (TW)

(73) Assignee: Insert Enterprise Co., Ltd. (TW)

( * ) Notice: Subject to any disclaimer, the term of this patent is extended or adjusted under 35 U.S.C. 154(b) by 0 days.

(21) Appl. No.: 09/911,421

(22) Filed: Jul. 25, 2001

(51) Int. Cl.[7] ..... H01R 29/00; H01R 9/22; H01R 13/73

(52) U.S. Cl. ..... 439/188

(58) Field of Search ..... 439/188, 541.5, 439/620, 944, 862, 507

(56) References Cited

U.S. PATENT DOCUMENTS 5,167,536 A * 12/1992 Wang ..... 333/185
5,387,116 A * 2/1995 Wang ..... 439/188
5,730,621 A * 3/1998 Wang ..... 439/541.5
5,803,757 A * 9/1998 Wang ..... 439/188
6,065,976 A * 5/2000 Wang ..... 439/581

* cited by examiner

*Primary Examiner*—Brian Sircus
*Assistant Examiner*—Chandrika Prasad
(74) *Attorney, Agent, or Firm*—Troxell Law Office PLLC

(57) ABSTRACT

An auto termination PCB mount connector provides a casing and there are insulators, a spring plate, a resistor, and a metal jacket mounted in the casing. The metal jacket urges the resistor to press against the conductive plate along a receiving groove in the casing. The casing at the outer side thereof joins a fixing element and the fixing element can be inserted into a hole in the printed circuit board so as to engage the connector to the printed circuit board. The spring plate contacts with the conductive plate in a normal state and the spring plate may separate from the conductive plate as soon as an insert end of any other connector is inserted into the printed circuit board. In case of the spring plate contacting with the conductive plate, an output signal transmitted to the spring plate may be sent back to the grounded line of the printed circuit board via the conductive plate, the resistor, the metal jacket, the casing, and the fixing element to constitute a loop. The present invention provides few parts and can be set up easily before being able to insert into the printed board. The resistor makes the loop have a better wave filtering effect to reduce the electromagnetic wave interference resulting from the signal from the spring plate and the loss of power output can be lowered too.

4 Claims, 13 Drawing Sheets

AUTO TERMINATION PCB MOUNT CONNECTOR

BACKGROUND OF THE INVENTION

1. Field of the Invention

The present invention relates to a connector for a signal transmission wire, and particularly to an auto termination printed circuit board (PCB) mount connector, which can provides a function of loop automatically.

2. Description of Related Art

The signal transmission between electric apparatuses is performed by way of a connector associated with transmission wires. The present inventor has invented many connectors with different structures and functions such as the Taiwanese Published No. 139815 entitled "IMPROVED BNC CONNECTOR FOR A COMPUTER", the Taiwanese Published No. 373827 entitled "CO-AXIS CONNECTOR FOR CABLES-ADDITION NO. 1", U.S. Pat. No. 5,730,621 entitled "DUAL-JACK ELECTRICAL CONNECTOR", and U.S. Pat. No. 5,167,536 entitled "CAPATIVE COUPLED BNC TYPE CONNECTOR" regarding to the signal transmission. A connector at the signal output end thereof usually may emit the electromagnetic wave to interfere neighboring electronic components before connecting with the output signal of another connector. In order to solve the interference problem resulting from the electromagnetic wave, the U.S. Pat. No. 5,387,116 owned by the present inventor has disclosed an auto termination BNC T adapter. However, the T adapter is not possible to be inserted into the printed circuit board due to no insert part being provided so that it is not suitable for being a connector engaging with the printed circuit board in case of other signal connectors being connected to the printed circuit board. In order to improve the connector disclosed in the U.S. Pat. No. 5,387,116, the present invention has developed an auto termination connector to engage with a socket on the printed circuit board directly.

SUMMARY OF THE INVENTION

An object of the present invention is to provide an auto termination PCB mount connector, which has advantages such as simple construct, being easily set up, a lower cost, and conveniently engaging with the printed circuit board.

Another object of the present invention is to an auto termination PCB mount connector, which is possible to reduce the interference resulting from the electromagnetic wave.

BRIEF DESCRIPTION OF THE DRAWINGS

The present invention can be more fully understood by reference to the following description and accompanying drawing, in which.

DETAILED DESCRIPTION OF THE PREFERRED EMBODIMENT

Figure 1:
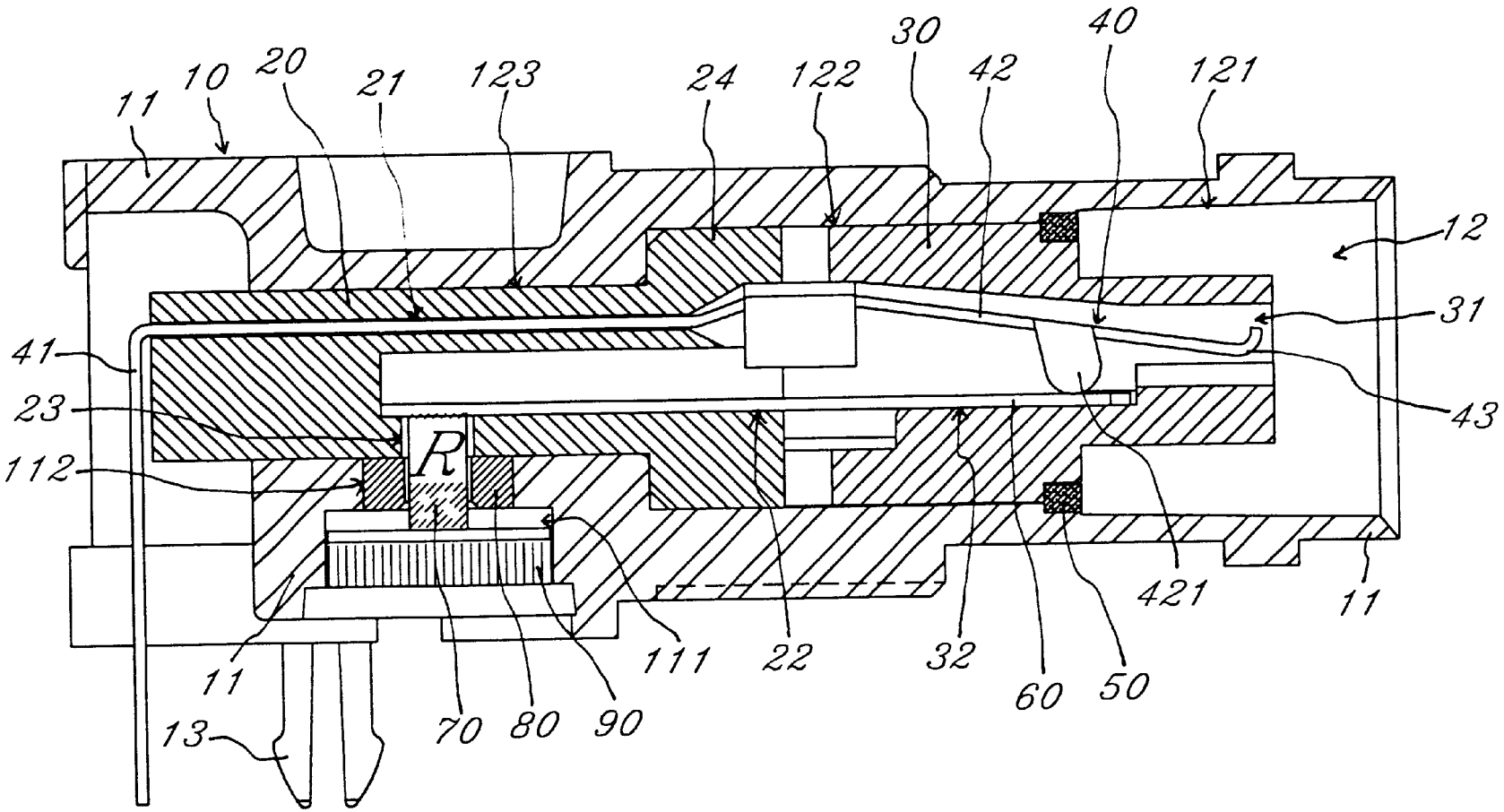
FIG. 1 is a sectional view of an auto termination PCB mount connector according to the present invention in a first embodiment thereof.

Referring to FIG. 1, a first embodiment of auto termination PCB mount connector according to the present invention comprises a casing 10 and the casing further comprises a rear insulator 20, a front insulator 30, a spring plate 40, a packing ring 50, a conductive plate 60, a resistor 70, an isolator 80 and a metal jacket 90. A casing wall 11 of the casing 10 at the inner side thereof has an elongated groove 12 and the elongated groove 12 pierces through both ends of the casing wall 11. The elongated groove 12 is divided into a large hole section 121, a medium hole section 122, and a small hole section 123, sequentially. The casing wall 11 adjacent to the small hole section 123 provides a receiving groove 111. The receiving groove 111 communicates with a small hole 112, which passes through the casing wall 11. The casing wall 11 at the outer side thereof provides a vertical fixing element 13. The casing 10 and the fixing element 13 are made of metal. The rear insulator 20 has a first guide groove 21, a second guide groove 22 and a hole 23, and an end thereof provides an engaging section 24 with an outer diameter larger than the rest part thereof. The hole 23 communicates with the second guide hole 22. The front isolator 30 has a pierced hole 31 and a guide groove 32. The spring plate 40 has a tail section 41, a slant section 42, and a touch section 43, and the slant section 42 extends a contact plate 421 and the touch section 43 has curve bend.

When the auto termination PCB mount connector shown in FIG. 1 is to be set up, the spring plate 40 at the tail section 41 thereof passes through the first guide groove 21 of the insulator 20 and extends outward, and the conductive plate 60 at an end thereof fits with the second guide groove 22. Then, the slant section 42 and the contact section 43 of the spring plate 40 are received in the pierced hole 30 of the front insulator 30, and the other end of the conductive plate 60 fits with the guide groove 32 of the front insulator 30. Next, the rear insulator 20 and the front insulator 30 are inserted into the casing 10 such that an end of the rear insulator 20 extends through the small hole section 123 and it makes the hole 23 communicate with the small hole 112 of the casing wall 11 and the engaging section 24 fits with a lateral side of the medium hole section 122. The front insulator 30 at an end thereof fits with the medium hole section 122 against the engaging section 24, and the other end thereof is received in the large hole section 121. Further, the packing ring 50 is stuffed between the outer wall of the front insulator 30 and the inner wall surface of the casing wall 11 to fix the rear insulator 30 and front insulator 30 in the casing 10. The resistor 70 is inserted into the hole 23 of the rear insulator 20 through the small hole 112 and the insulator 80 with a central through hole fits with the resistor 70 so as to be disposed in the small hole 112 and keep untouched with the casing wall 11. Finally, the metal jacket 90 is pressed tightly from the receiving groove ill of the casing wall 11 toward the inner side of the casing 10 to contact and press the resistor 70 against the conductive plate 60.

While the auto termination PCB mount connector of present invention shown in FIG. 1 is in use, the fixing element 13 is inserted into a groove in a printed circuit board so as to be in conjunction with the printed circuit board. The spring plate 40 has the contact plate 421 to keep contact with the conductive plate 60 in a normal state. If an engaging end of any other connector is inserted, the spring plate 40 at the touch section 43 may contact the engaging end right away and the engaging end may prop up the touch section 43 and the contact plate 421 to keep the contact plate 421 separate from the conductive plate 60. As soon as the engaging end of the other connector is detached, the contact plate 421 of spring plate 40 may spring back to the original position thereof to contact the conductive plate 60 again such that a signal is output from the spring plate 40 may be sent back to the grounded line of the printed circuit board through the conductive plate 60, the resistor 70, the metal jacket 90, the casing 10, and the fixing element 13 to constitute a loop. Due to the resistor 70, the loop can provide a better wave filtering function. In this way, the interference problem of the electromagnetic wave resulting from the output signal of the spring plate 40 can be reduced and a less loss of power output can be obtained too.

Figure 2:
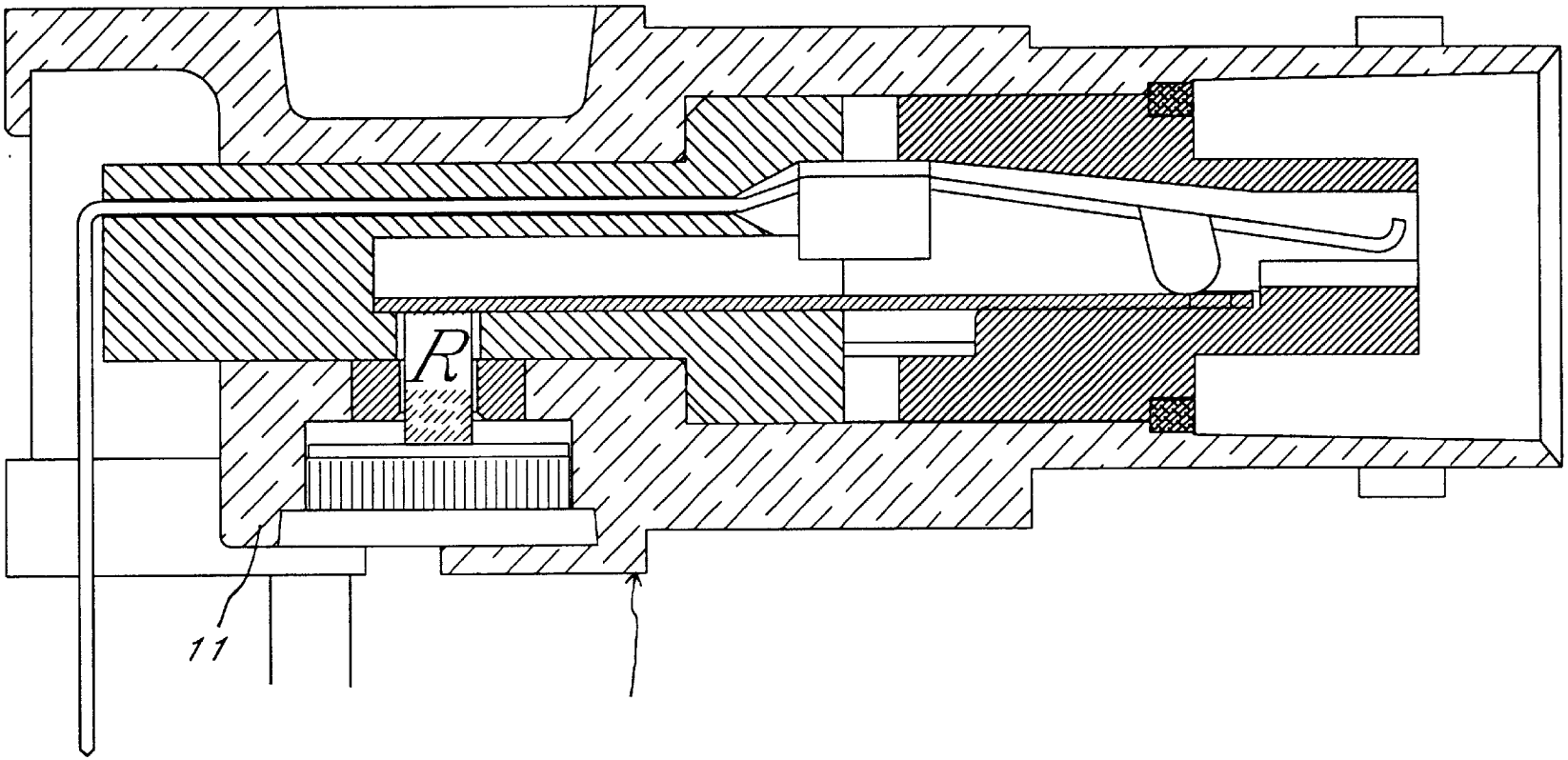
FIG. 2 is a sectional view of an auto termination PCB mount connector according to the present invention in a second embodiment thereof.

Although the fixing element 13 shown in FIG. 1 provides a shape with double hooks, it is possible to be changed to a shape of cylinder as the fixing element 14 of the second embodiment shown in FIG. 2. The third embodiment of the present invention is shown in FIG. 3 illustrates the fixing element 14 is in conjunction with the casing wall 11 of the casing 10 horizontally and disposed at the upper left side of the casing 10.

Figure 3:
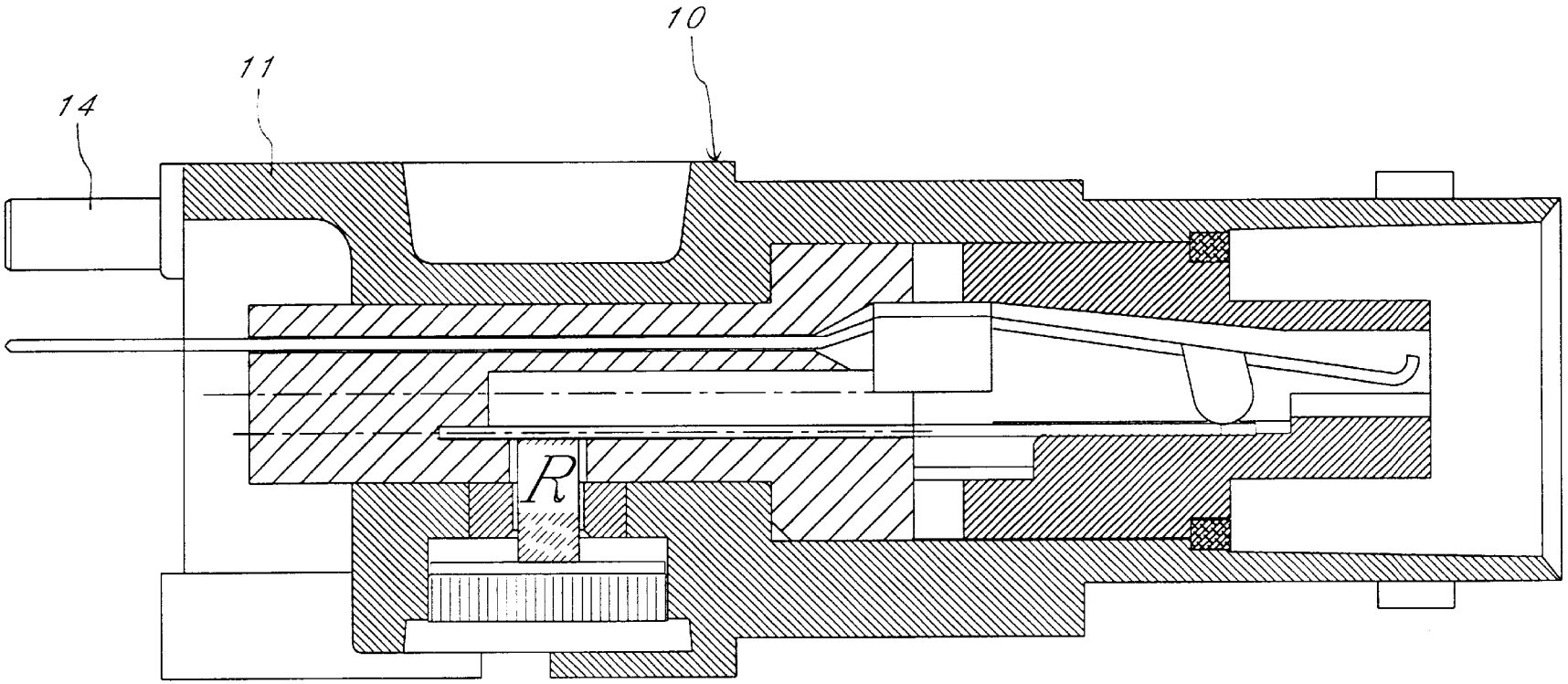
FIG. 3 is a sectional view of an auto termination PCB mount connector according to the present invention in a third embodiment thereof.
Figure 4:
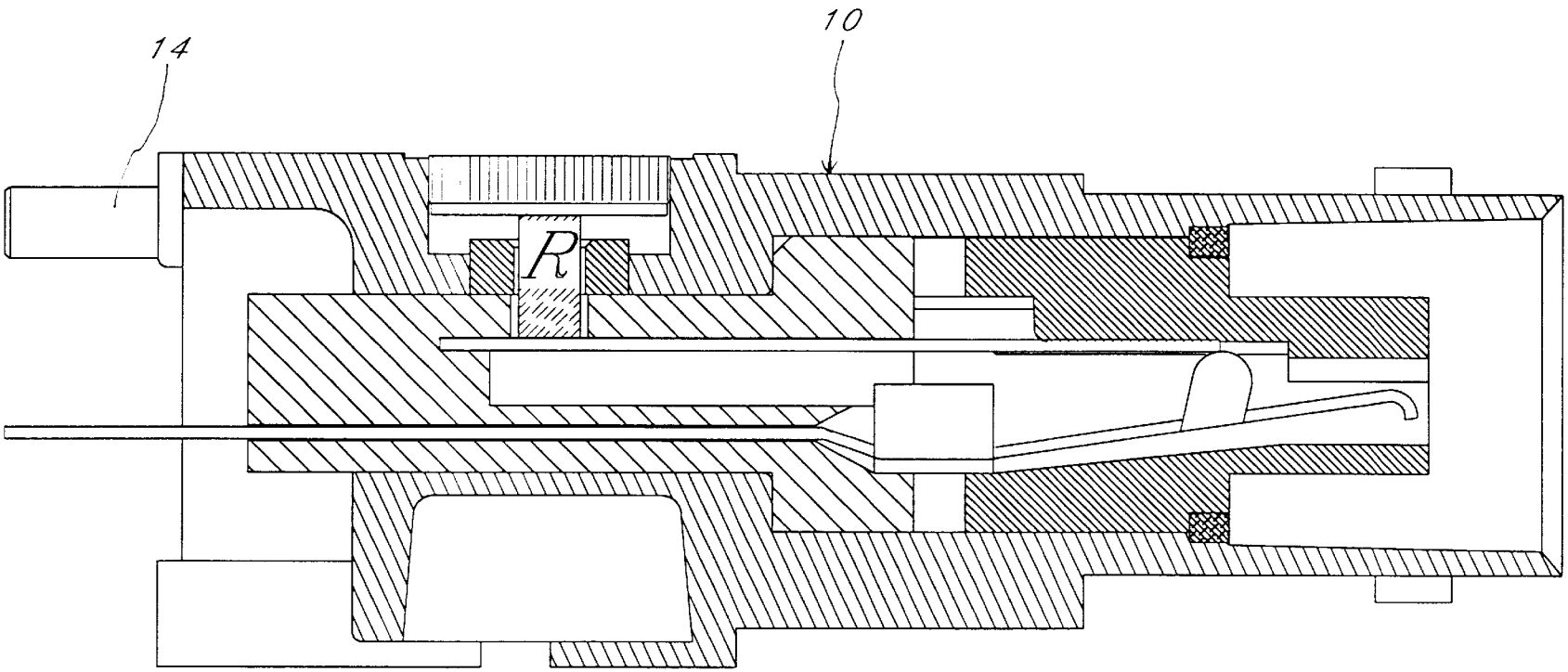
FIG. 4 is a sectional view of an auto termination PCB mount connector according to the present invention in a fourth embodiment thereof.

Referring to FIG. 4, the fourth embodiment of the present invention is illustrated that all the components therein are disposed inversely with respect to the components in the third embodiment shown in FIG. 3.

Figure 5:
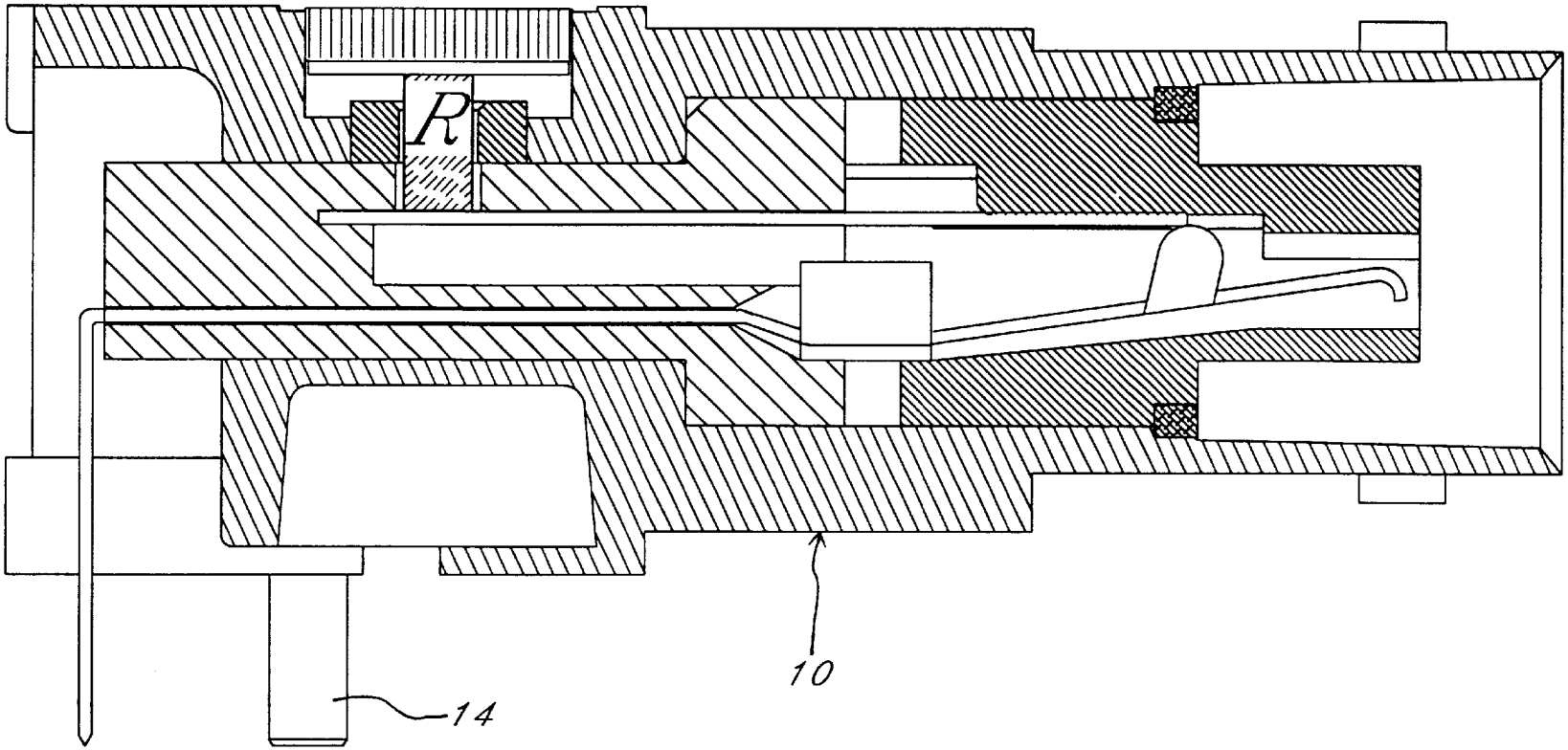
FIG. 5 is a sectional view of an auto termination PCB mount connector according to the present invention in a fifth embodiment thereof.

The fixing element 14 shown in FIG. 4 is disposed at the upper left side if the casing 10, but the fifth embodiment shown in FIG. 5 illustrates the fixing element 14 is disposed under the casing 10.

Figure 6:
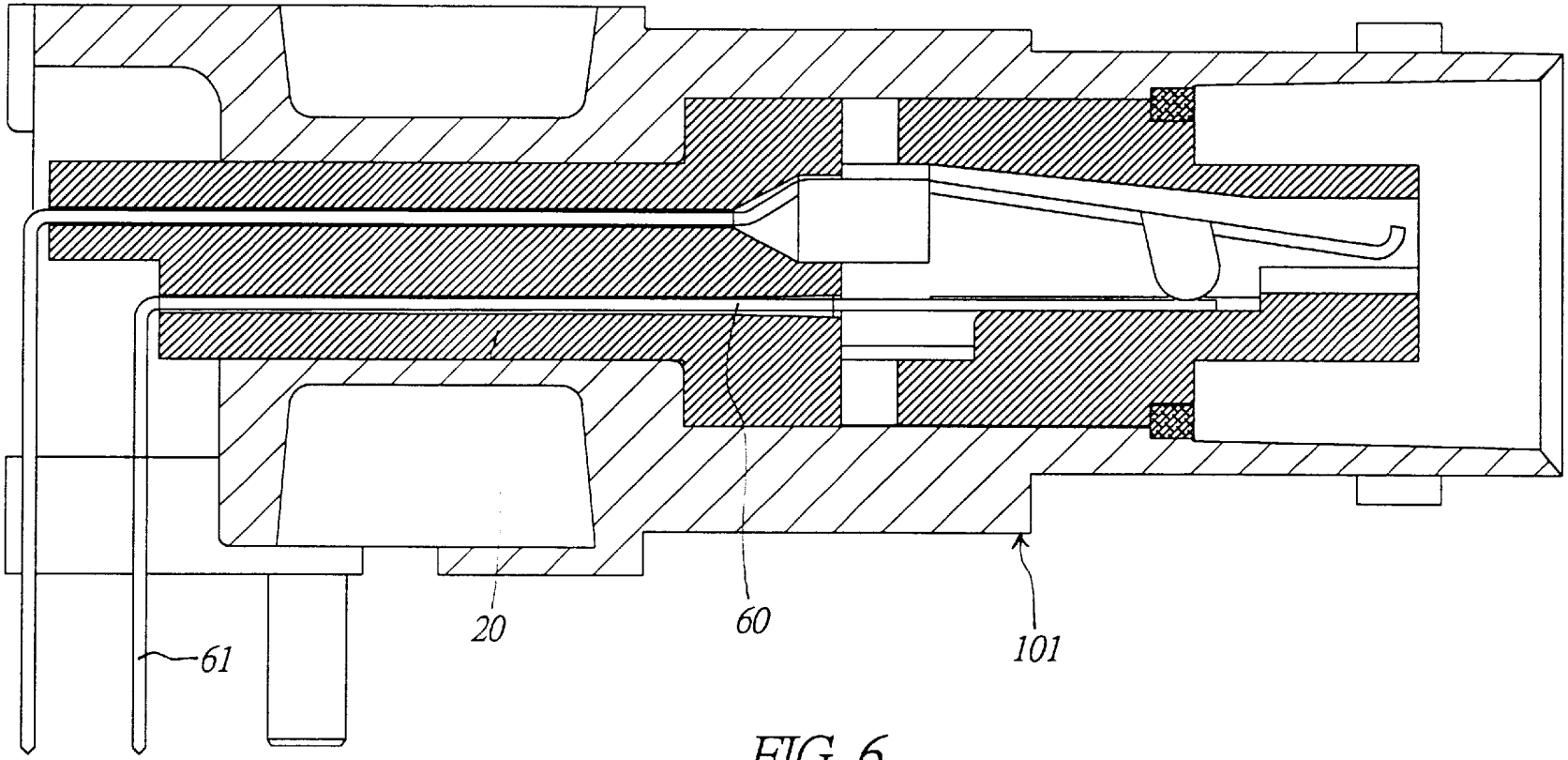
FIG. 6 is a sectional view of an auto termination PCB mount connector according to the present invention in a sixth embodiment thereof.

Referring to FIG. 6, the sixth embodiment of the present invention has a casing 101 but no components such as the resistor 70, the insulator 80, and the metal jacket 90 in the casing 101 and these components are provided in the casing 10 in the second embodiment shown in FIG. 2. Nevertheless, the conductive plate 60 has a tail section 61 extending outward the rear insulator 20 and the casing 101.

Figure 7:
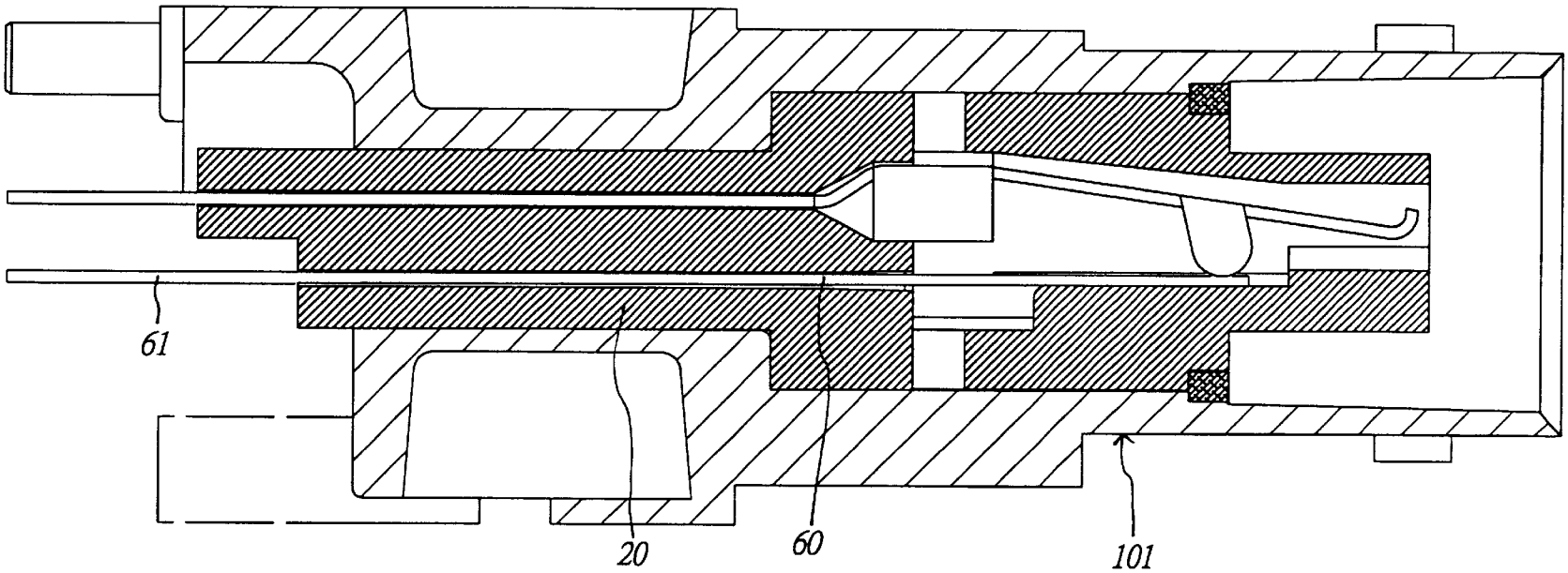
FIG. 7 is a sectional view of an auto termination PCB mount connector according to the present invention in a seventh embodiment thereof.

Referring to FIG. 7, the seventh embodiment of the present invention has a casing 101, but the auto termination loop in the casing 10 provides no components such as the resistor 70, the insulator 80, and the meal jacket 90, which are provided in the third embodiment of the connector shown in FIG. 3. Nevertheless, the conductive plate 60 has a tail section 61 extending outward the rear insulator 20 and the casing 101.

Figure 8:
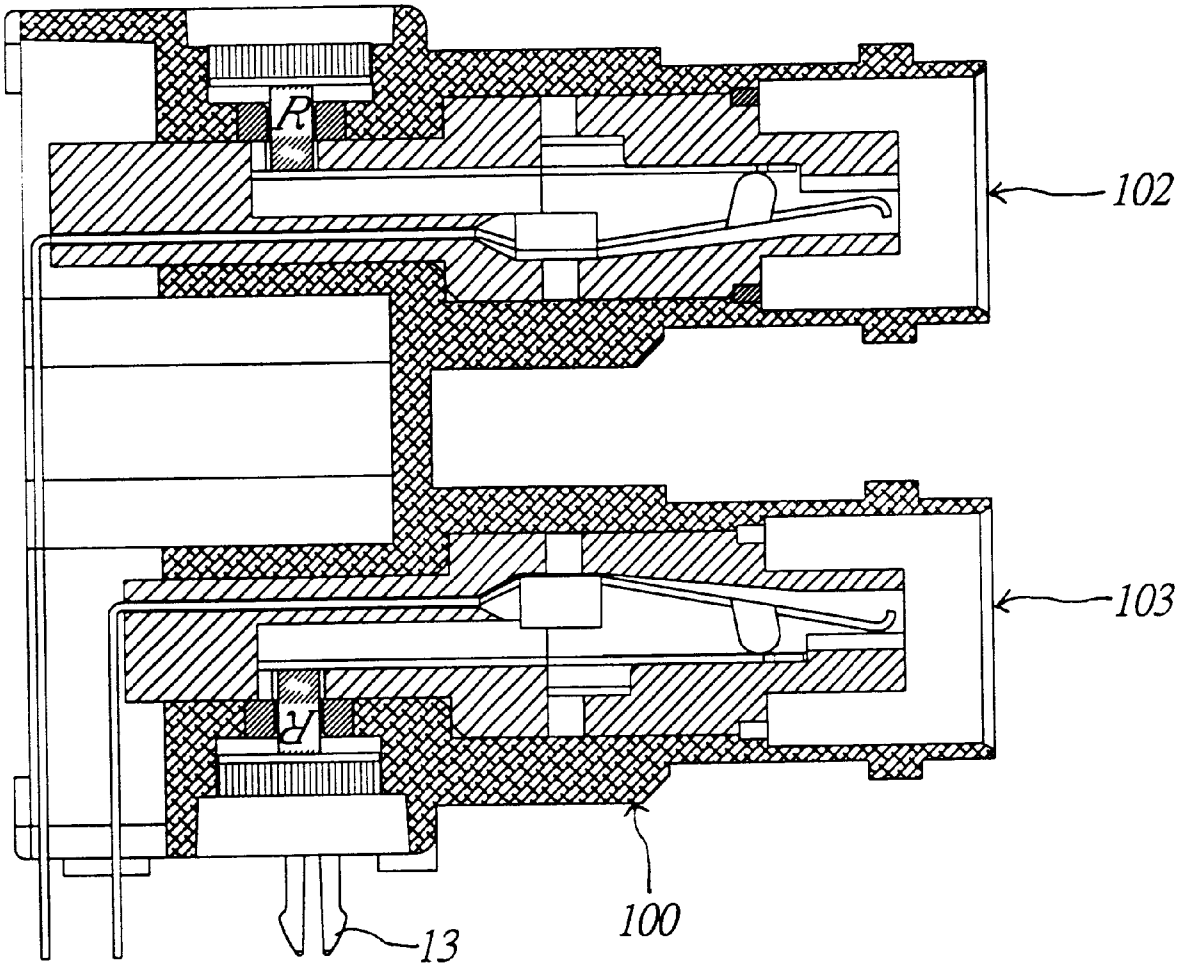
FIG. 8 is a sectional view of an auto termination PCB mount connector according to the present invention in a eighth embodiment thereof.

Referring to FIG. 8, the eight embodiment of the present invention provides two opposite casings 10 expanded from the single casing 10 of the first embodiment to constitute dual casings 100. The dual casing 100 has an upper connecting end 102 and a lower connecting end 103 and the two connecting ends provides an automatic termination loop respectively. Further, the fixing element 13 of the dual casings 13 is disposed under the dual casing 100.

Figure 9:
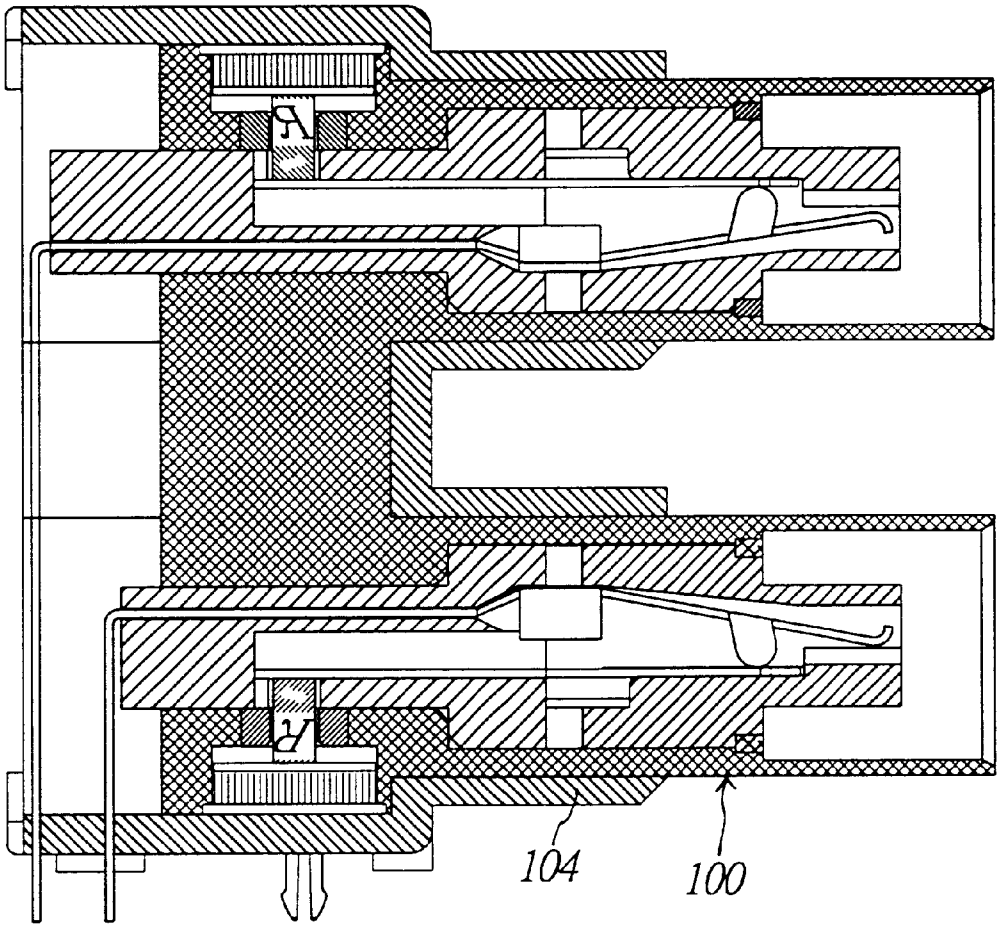
FIG. 9 is a sectional view of an auto termination PCB mount connector according to the present invention in a ninth embodiment thereof.

Referring to FIG. 9, the ninth embodiment of the present invention provides an insulator cover 104 at the left portion of dual casings 100 shown in FIG. 8.

Figure 10:
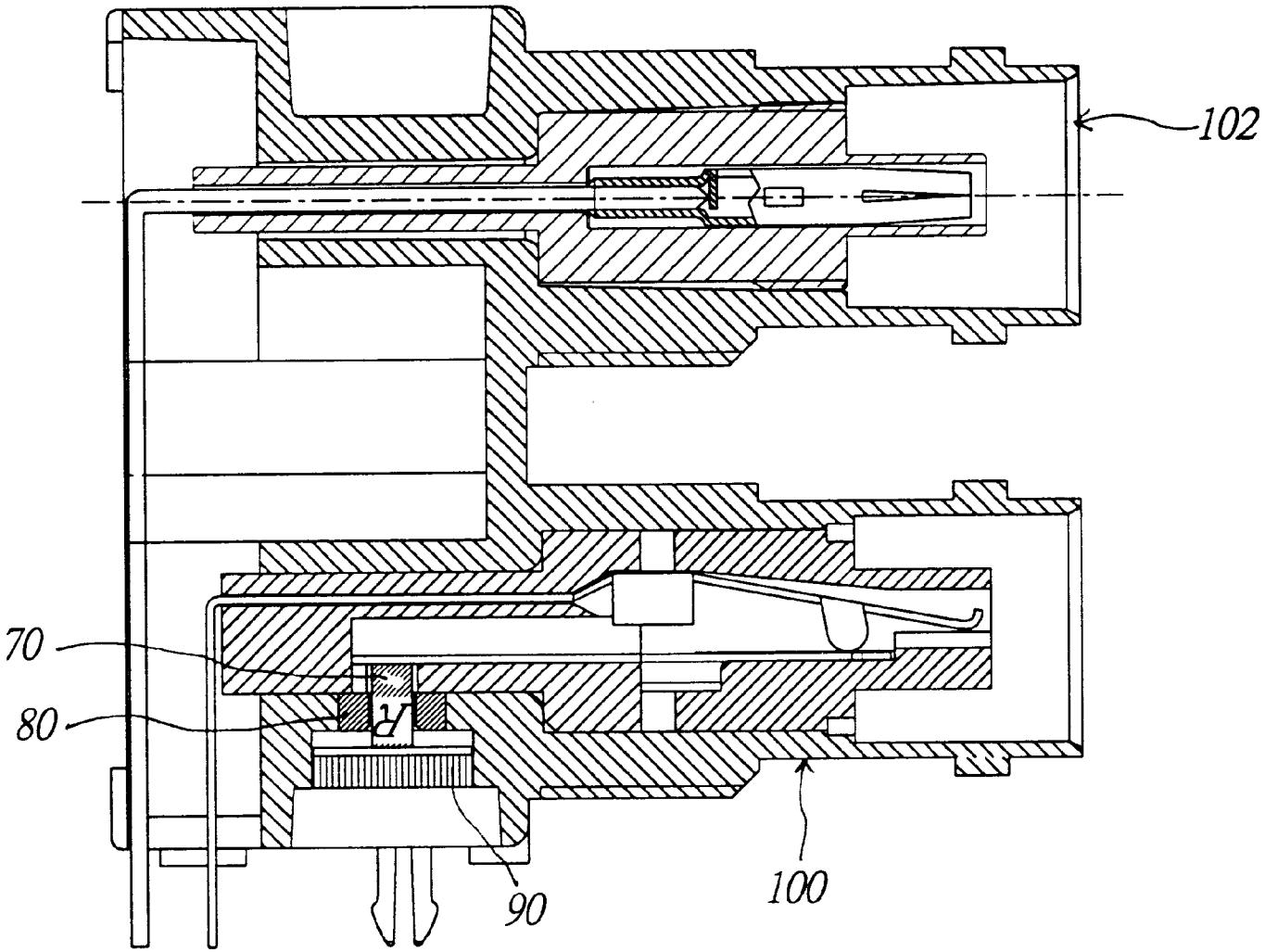
FIG. 10 is a sectional view of an auto termination PCB mount connector according to the present invention in a tenth embodiment thereof.

Referring to FIG. 10, the tenth embodiment of the present invention provides a termination connector with dual casings 100 as the eighth embodiment does, but the automatic termination loop at the upper connecting end 102 provides no components such as the resistor 70, the insulator 80 and metal jacket 90 therein.

Figure 11:
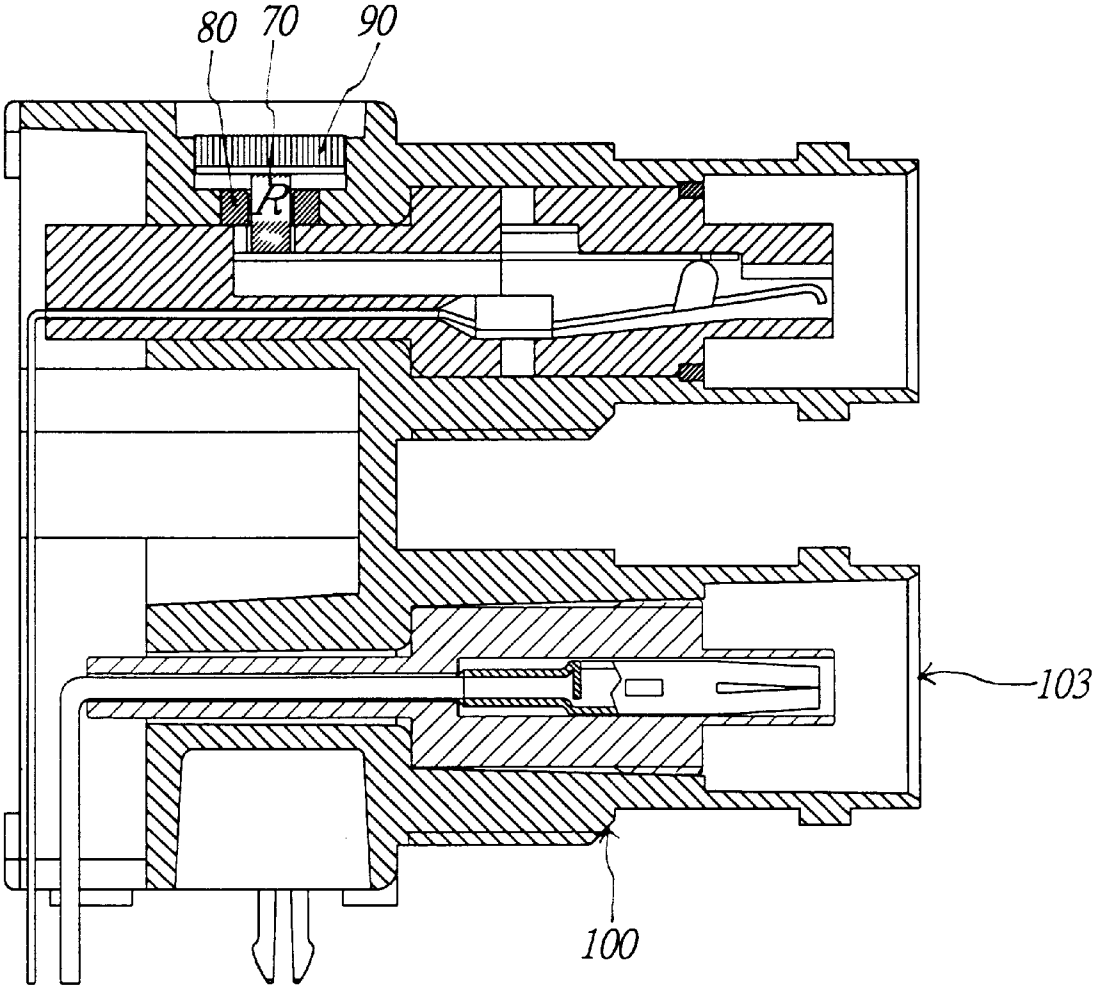
FIG. 11 is a sectional view of an auto termination PCB mount connector according to the present invention in a eleventh embodiment thereof.

Referring to FIG. 11, the eleventh embodiment of the present invention provides a termination connector with dual casings 100 as the eighth embodiment does, but the automatic termination loop at the lower connecting end 103 provides no components such as the resistor 70, the insulator 80 and metal jacket 90 therein.

Figure 12:
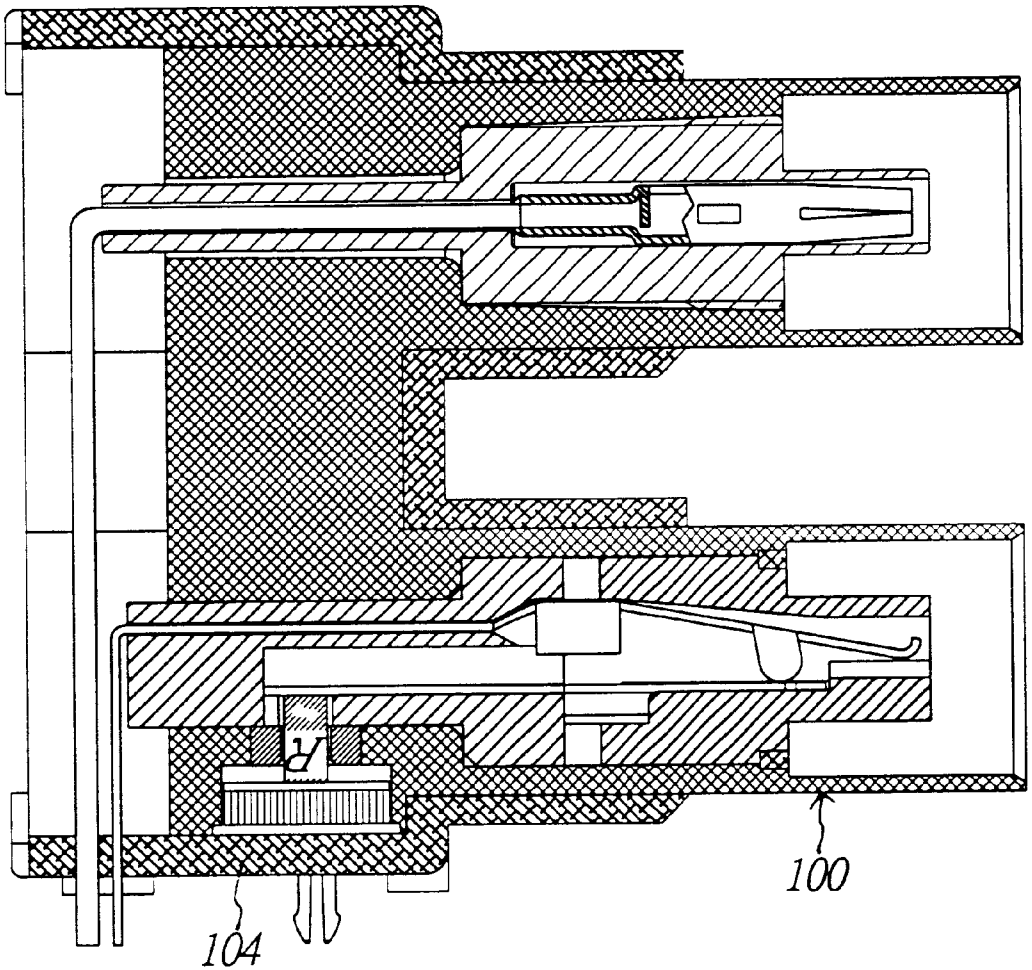
FIG. 12 is a sectional view of an auto termination PCB mount connector according to the present invention in a twelfth embodiment thereof.

Referring to FIG. 12, the twelfth embodiment of the present invention provides an insulator cover 104 at the left portion of dual casings 100 shown in FIG. 10.

Figure 13:
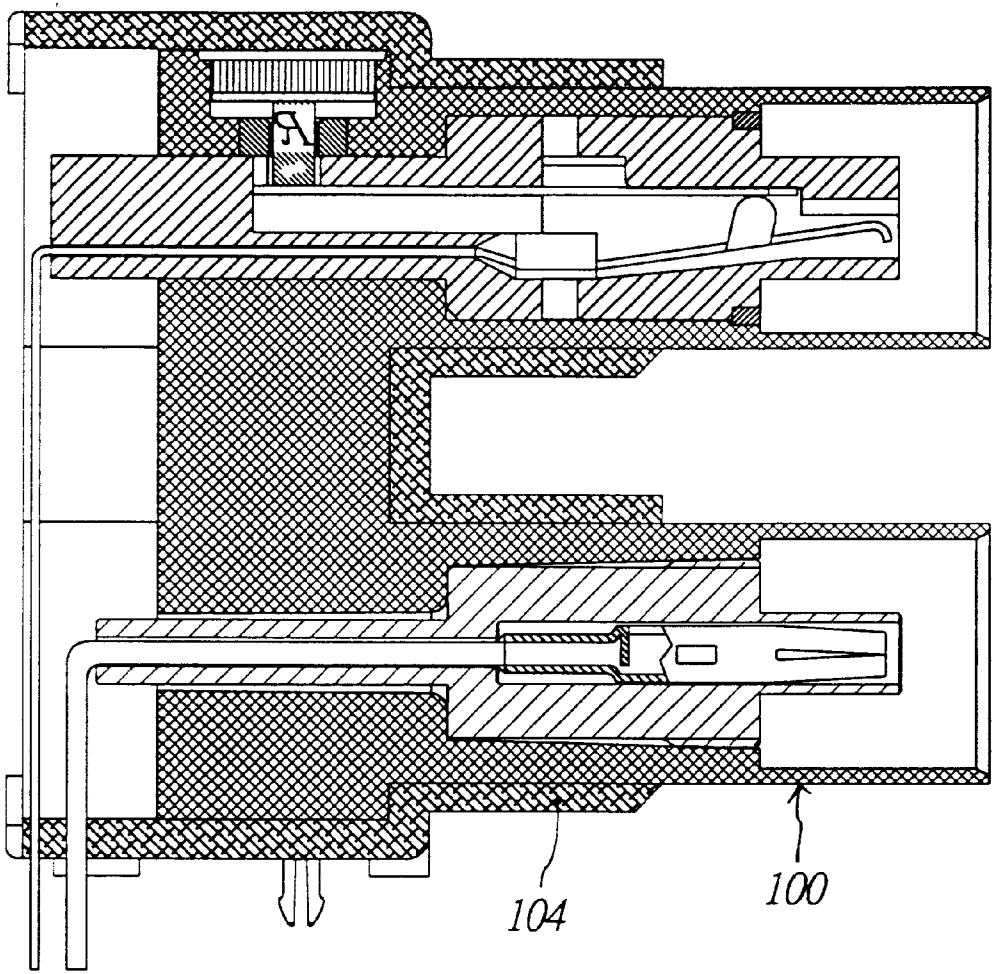
FIG. 13 is a sectional view of an auto termination PCB mount connector according to the present invention in a thirteenth embodiment thereof.

Referring to FIG. 13, the thirteenth embodiment of the present invention provides an insulator cover 104 at the left portion of dual casings 100 shown in FIG. 11.

The auto termination PCB mount connector of the present invention has features such as providing a design of loop, being possible to be inserted onto the print circuit board, having less part elements so that it is easier for a user to set up the connector of the present invention easily and it costs lower while the connector of the present invention is fabricated. Furthermore, the resistor arranged in the connector of the present invention can offer a better function of wave filtering such that the electromagnetic wave interference problem resulting from the signal sent out by the spring plate can be reduced and the loss of the power output can be lowered.

While the invention has been described with reference to preferred embodiments thereof, it is to be understood that modifications or variations may be easily made without departing from the spirit of this invention, which is defined by the appended claims.

What is claimed is:

1. An auto termination PCB mount connector, comprising:

a casing with a casing wall, being made of metal the casing wall providing a receiving groove and a small through hole, the receiving groove communicating with the through hole;

a rear and a front insulators, being disposed in the casing respectively, the rear insulator proving a hole communicating with the small through hole in the casing wall;

a fixing element, being made of metal and being in conjunction with an outer side of the casing wall;

a spring plate with a conductive plate, being provided in the rear and the front insulators, having a tail section, a slant section, and a touch section, the slant section thereof extending a contact plate to contact with the conductive plate in a normal state, the tail section piercing the rear insulator and extending outward the casing, and the contact section thereof being to be touched by an insert end of any other connector;

a resistor, being received in the receiving groove, passing over the small through hole and extending into the hole in the rear insulator;

a third insulator, providing a central through hole fitting with the resistor, and being disposed in the small through hole to allow the resistor in a state of being not contacting with the casing, and a metal jacket, being placed in the receiving groove to urge toward an inner side of the casing so as to contact and press the resistor against the conductive plate;

whereby, as soon as the spring plate at the contact section thereof contacts with the insert end of anodating connector and the insert end props up the touch section and the contact plate to keep the contact plate separate from the conductive plate; and as soon as the insert end is detached from the spring plate, the contact plate of the spring plate can spring back to an original position thereof.

2. The auto termination PCB mount connector according to claim 1, wherein the casing wall at the inner side thereof further comprises an elongated groove piercing both ends of the casing and the elongated groove has a large hole section, a medium hole section, and a small hole section sequentially; the rear insulator further comprises an end extending outward the small hole section, and a engaging section with a big outer diameter fitting with a lateral side of the medium hole section; the front insulator further comprises an end fitting with the medium hole section and urging against the fixing section of the rear insulator, another end being received in the large hole section; and a packing ring is provided to stuff tightly between an outer wall surface of the front insulator and an inner wall surface of the casing wall to retain the rear insulator and the front insulator in the casing.

3. The auto termination PCB mount connector according to claim 1, wherein the fixing element extends upright from the casing wall.

4. The auto termination PCB mount connector according to claim 1, wherein the fixing element provides a shape of double hooks or a cylinder.

* * * * *